US005863241A

United States Patent [19]

Rottschy

[11] Patent Number: 5,863,241

[45] Date of Patent: Jan. 26, 1999

[54] DEVICE TO SAND OR POLISH FLOORS AND OTHER SURFACES

[75] Inventor: Joachim Rottschy, Sprockhövel, Germany

[73] Assignee: Witte-Metallwaren GmbH, Beckum, Germany

[21] Appl. No.: 979,851

[22] Filed: Nov. 26, 1997

[30] Foreign Application Priority Data

Nov. 28, 1996 [DE] Germany ..... 196 49 282.3

[51] Int. Cl.[6] ..... B24B 7/28

[52] U.S. Cl. ..... 451/271; 451/353

[58] Field of Search ..... 451/271, 270, 451/350, 353, 357

[56] References Cited

U.S. PATENT DOCUMENTS

| | | | |
|---|---|---|---|
| 835,631 | 11/1906 | Mooney et al. | 451/353 |
| 862,747 | 8/1907 | Miller | 451/271 |
| 2,007,073 | 7/1935 | Clarke | 451/353 |
| 2,649,669 | 8/1953 | Tobis | 451/271 |
| 5,170,595 | 12/1992 | Wiand | 451/353 |
| 5,548,860 | 8/1996 | Weltikol et al. | 451/353 |

FOREIGN PATENT DOCUMENTS

| | | | |
|---|---|---|---|
| 536180 | 6/1958 | Italy | 451/353 |

*Primary Examiner*—Robert A. Rose
*Attorney, Agent, or Firm*—Burns, Doane, Swecker & Mathis, L.L.P.

[57] ABSTRACT

A floor sanding or polishing device includes a housing that can be guided across a floor. The housing carries a motor which rotates a plate in a first direction about a vertical axis. The plate carries a plurality of sanding or polishing discs that are rotatable in the same second directions which are opposite to the first direction of rotation of the plate. The discs are displaceable radially relative to the plate by centrifugal force to bring a gear of the disc into engagement with a ring gear affixed to the housing, whereby the discs are rotated about their respective axes in response to rotation of the plate.

9 Claims, 4 Drawing Sheets

DEVICE TO SAND OR POLISH FLOORS AND OTHER SURFACES

BACKGROUND OF THE INVENTION

The invention concerns a device to sand or polish floors or surfaces which incorporates a motor-driven sanding or polishing disc that rests during operation on the floor or floor surface in order to treat that surface and whereby a handle element is mounted on the housing to guide the device across the surface.

Such devices to sand or polish floors or surfaces are primarily used, for example, to treat wood or cork floors, but can also be used to treat other types of floor sub-surfaces. In the process, the surface of the floor is so treated by the device, that the surface is smoothed by sanding using a rotating disc or can also have a gloss texture imparted by polishing. Chemicals can also be sanded-in or polished-in during treatment of the floor. The devices used for sanding or polishing contain a motor drive which, for example, could be an electric motor. This motor causes rotation of a sanding or polishing disc which rotates on the surface of the floor while the device operates and whereby the rotating sanding or polishing disc can be guided across the surface to be treated by a standing person using the handle. The pressure required for sanding or polishing the surface to be treated is provided during operation of the device by the device's own weight.

A basic disadvantage of such a sanding or polishing device constructed in accordance with the currently known state of technology consists particularly in the existence of a strong sideward force during the operation of the machine, making controlled sanding or polishing only possible by the operator's use of force. The machine always tries to slide to the side. In addition, there also is the resulting disadvantage that, because of dynamic forces, the circumference area of the sanding or polishing disc always tries to penetrate into the floor or surface, thereby representing a severe impediment when treating a soft floor, like wood or cork floors. The known sanding and polishing device, after it has been placed in operation, always tends to wander from the starting position without the operator having exerted any influence at all. In order to counter this movement, the operator is required to exert much force and use skill in order to make possible a concentrated, controlled sanding or polishing of the surface. An additional disadvantage of this known device is the high consumption of sanding material because of the sideward force.

It is therefore an object of this invention to further develop beyond the stated stage of technology a device to sand or polish a floor or surface which, on the one hand, manifests controlled guiding stability and, on the other hand, conserves the use of sanding or polishing material during operation of the device. Another object is to provide a simple way of achieving the counter-rotation of the discs, and also of starting/stopping the rotation.

SUMMARY OF THE INVENTION

The objects are achieved by the invention in which the sanding or polishing disc is formed from several discs which will effectively driven in directions opposite a direction of rotation of a plate to which the discs are mounted. This arrangement will be advantageous because during operation the device will be so stable with regard to its location and guidance, that the operator can guide it in a controlled manner without counter-steering. Based on the arrangement of multiple discs which rotate counter to the plate, so-called dynamic forces in the system will so cancel each other out, that so compensated force system results with regard to the rotating parts. This leads, on the one hand, to a neutralization of the wandering of the machine during operation and, on the other, to a significant reduction of the use of sanding and polishing material because of the controlled and stably guided support of the device on the floor. That is because the device, which is supported on the floor by its own weight, manifests an exactly uniform surface support because of the closed dynamic force system, with the result that no so-called circumferential dependent stresses can arise on the surfaces of the individual discs and therefore a uniform use of sanding or polishing material is ensured, resulting in less use of the material.

In an advantageous further development of the invention, the plate can be removed from the housing of the device. Thus, varying arrangements of sanding discs can be used on the device to either sand or polish during the treatment of different types of floors, like hard or soft floors. It is therefore conceivable, for example, to use a single disc sanding machine for hard floors, whereas to treat soft floors the plate can be removed and replaced by a plate of the type containing several sanding or polishing discs. It is thereby preferable to mount four individual sanding discs on the removable plate. In that regard slots are provided on the plate to accept the individual discs axles. The disc axles are then located inside the plate.

Geared or friction wheels are placed on the free ends of the disc axles above the plate in order to provide the individual sanding discs with the appropriate turning moment for rotation. When the device is placed in operation, the geared or friction wheels make contact during operation of the device with an annular guide track located on the interior wall of the housing. In order to achieve a neutral condition for the machine, the disc axles are retracted radially inwardly by springs. When the rotary speed of the plate is increased above a certain valve, a so-called self-activation coupling of the geared or friction wheels with the guide track is achieved by centrifugal force which forces the discs radially outwardly while overcoming the spring force. If the operator desires, for example, to stop the device in one location, the operator merely needs to lower the rotary speed of the plate. If the floor treatment is to continue, there only to increase the rotary speed again so that the sanding discs are coupled to the guide track by the centrifugal action and further treatment of the floor can be continued.

In another version of the invention, self-adhesive sanding or polishing paper is secured to the discs, adherence or is accomplished by means of Velcro fasteners. Therefore after an appropriate number of operating hours the sanding and polishing material can be easily and simply replaced.

BRIEF DESCRIPTION OF THE DRAWING

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT OF THE INVENTION

Figure 1:
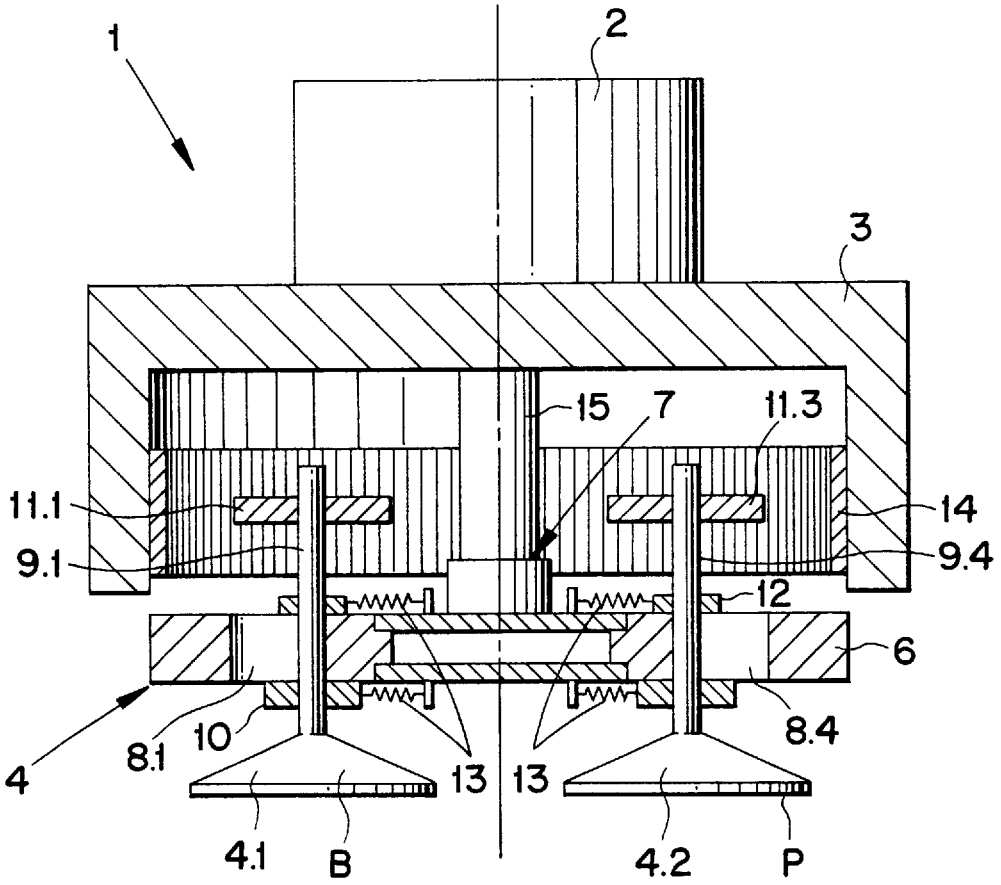
FIG. 1 is a schematic, vertical sectional view of the invention without the appropriate handle element, and with the driven gears in retracted positions.
Figure 4:
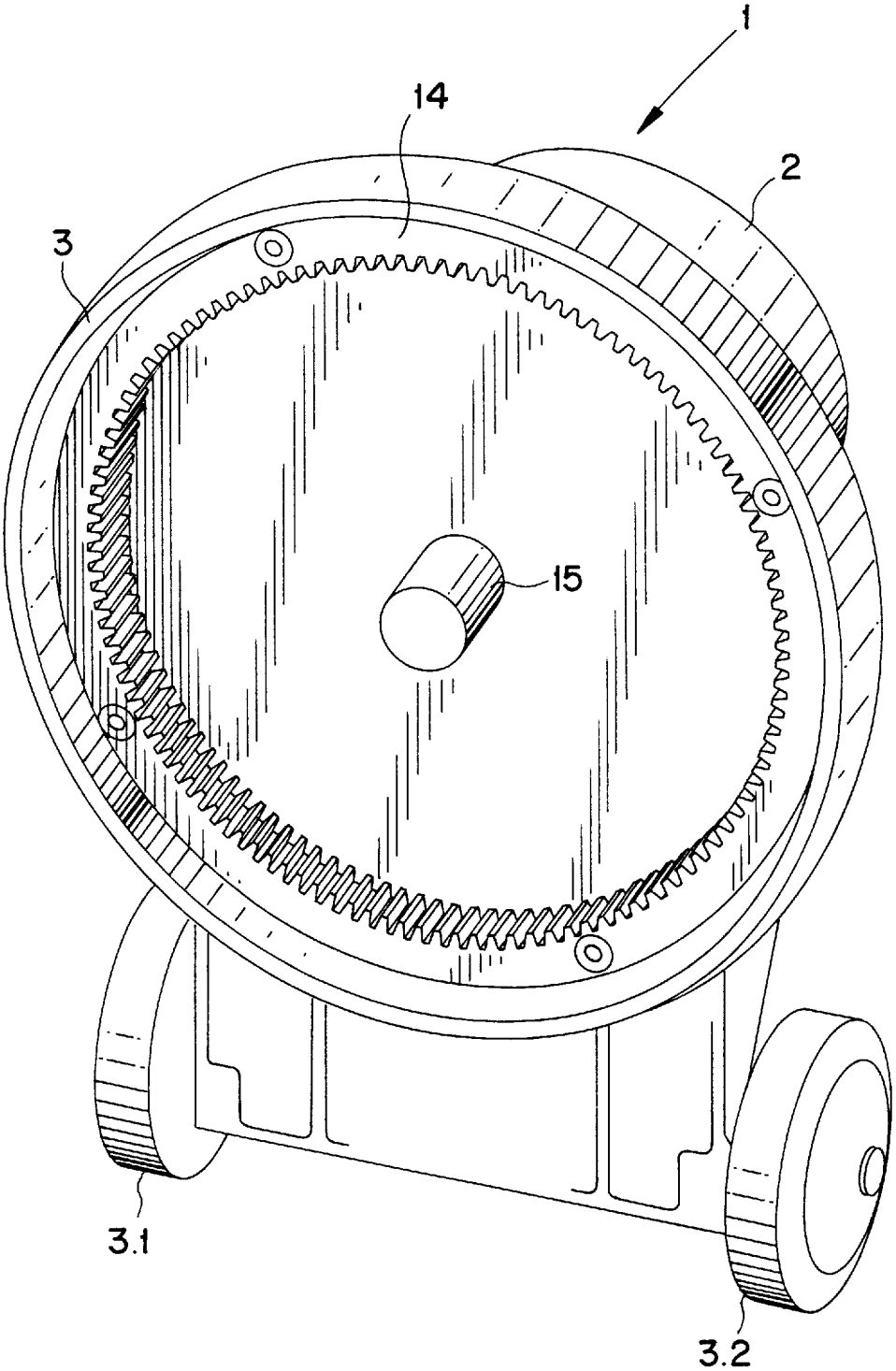
FIG. 4 is a perspective bottom view of the invention with parts thereof removed.

FIG. 1 shows a schematic representation of a floor polisher/sander device 1. The device 1 basically comprises a drive motor 2 which is located on a housing 3 and fixed to a drive shaft 15. The housing 3 is open toward the floor, in order that rotating sanding or polishing discs can be attached. A chassis with wheels 3.1 and 3.2 is placed on the housing 3 as shown in FIG. 4 in order to allow the device 1 to move easily. When the device 1 is in operation, a sanding or polishing disc assembly 4 resets on the floor surface and is placed in rotation by the motor 2. Guiding of the device 1 occurs by means of a conventional handle element which is not depicted and by means of which the device 1 is guided over the floor or surface to be treated. According to this invention the device 1 incorporates several sanding or polishing discs 4.1, 4.2, 4.3 and 4.4, which are effectively linked together by a drive transmission which drives them in common directions as will be explained.

Figure 3:
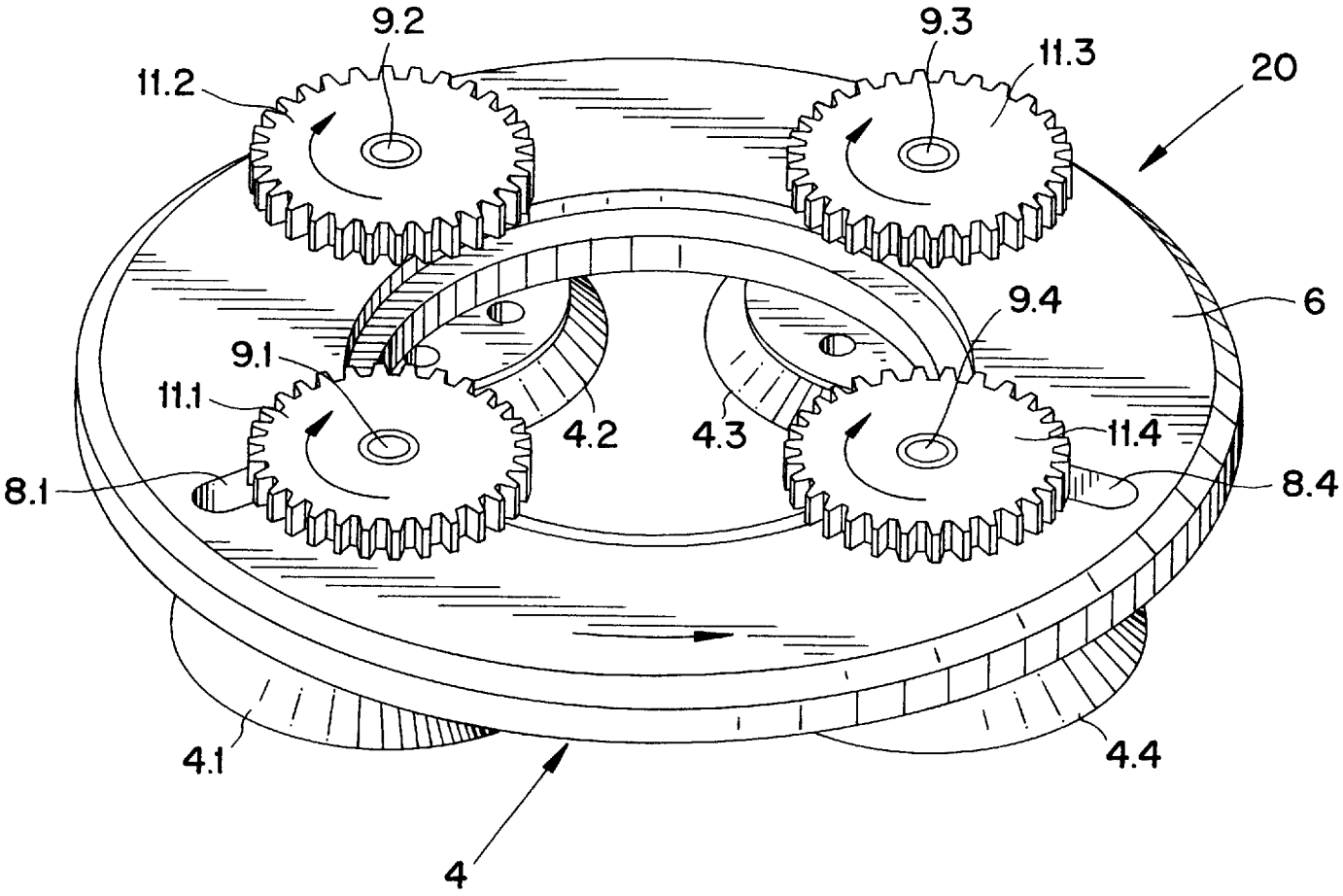
FIG. 3 is a perspective representation of the plate arrangement and its four discs.

As shown in particular in FIG. 3, the sanding or polishing disc assembly 4 comprises the individual discs 4.1, 4.2, 4.3 and 4.4 mounted on a plate 6 which can be removed from the housing 3. Any suitable releasable coupling such as for instance, a screw threaded connection or a bayonet lock 7 of known construction connects the plate 6 to the motor drive shaft 15 by means of which the plate 6 can be removed from the device 1. The use of a conventional bayonet lock 7 allows for various exchangeable types of plates 6 to be placed on the device 1.

Figure 2:
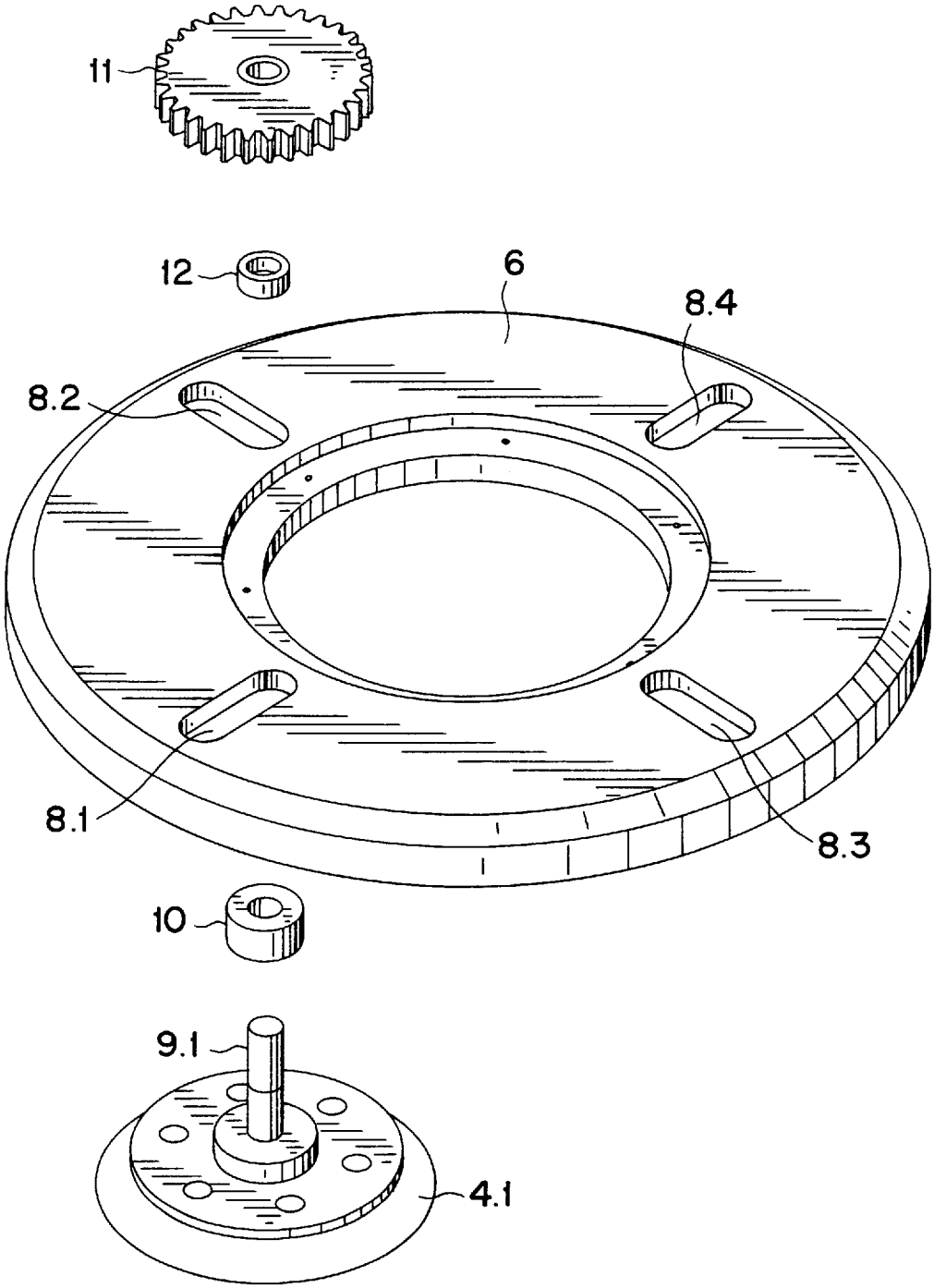
FIG. 2 is a perspective exploded representation of the invention.

As can be recognized from the exploded view shown in FIG. 2 there are slots 8.1, 8.2, 8.3 and 8.4 arranged in a circular pattern in the plate 6 and which are designed to accept individual disc axles 9.1, 9.2, 9.3 and 9.4. Each of the disc axles is rotatably mounted in the plate 6 by means of two (i.e., upper and lower) bearings 12, 10 which can be of any suitable type, such as standard ball bearings for example. As will become apparent, the bearings 10, 12 are slidable along an upper surface of the plate 6. The drive transmission comprises wheels such as friction wheels or, as shown in the drawing, toothed gears 11.1, 11.2, 11.3 and 11.4. Those gears are mounted on upper free ends of respective disc axles for rotation therewith, e.g., by being keyed thereto, and are held axially on the disc axles by suitable fasteners such as conventional split locking rings (not shown). The plate 6 therefore serves as the carrier for the individually rotating discs 4.1, 4.2, 4.3 and 4.4.

Affixed to an inside surface of the housing 3 is an annular guide track in the form of a ring gear 14. The axles 9.1, 9.2, 9.3 and 9.4 are radially movable relative to the plate 6 against the force of respective springs 13 by centrifugal force. That is, due to the centrifugal forces operating because of the rotation of the plate 6, the disc axles 9.1, 9.2, 9.3 and 9.4 are urged radially outward against the force of the springs 13 in such a way, that the gears 11.1, 11.2, 11.3 and 11.4 make contact with the guide track 14 and are caused to be rotated. Although the guide track 14 is shaped as an internal ring gear, it could instead comprise a frictional track if friction wheels were employed instead of the toothed wheels 11.1–11.4.

In operation, the motor 2 rotates the plate 6, and the axles 9.1–9.4 rotate therewith. Initially, the axles are pulled into the radially retracted positions, out of engagement with the ring gear 14, by the springs 13 as shown in FIG. 1. When centrifugal force becomes great enough to overcome the force of the springs, the axles 11.1–11.4 are displaced radially outwardly whereby the gears 11.1–11.4 engage the ring gear 14. As the plate rotates thereafter, the gears 11.1–11.4 and the discs 4.1–4.4 are rotated in common directions which are opposite the direction of rotation of the plate, whereby forces generated by the rotation of the plate are opposed by forces generated by the rotation of the individual discs. When the rotation speed of the plate 6 is reduced sufficiently to enable the spring force to overcome the centrifugal force, the discs are retracted radially inwardly and no longer rotate.

In another advantageous variation of the invention, sanding or polishing paper P can be attached to a body B of the discs 4.1, 4.2, 4.3 and 4.4 by adhesive or the paper P can be attached using Velcro fastening (not shown).

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. Apparatus for treating a floor surface comprising:

housing adapted to be guided across a floor;

motor mounted on the housing and connected to a vertical drive shaft;

a plate mounted to a lower end of the drive shaft to be driven thereby in a first direction;

a plurality of floor treating discs mounted to the plate to be rotated relative to the plate in second directions opposite to the first direction; and a guide track affixed to an inner surface of the housing;

each disc including a wheel affixed thereto and engageable with the guide track to be driven thereby in response to rotation of the plate;

the discs being movable radially with respect to the plate, springs connected to the discs for yieldably urging the discs radially inwardly, the discs adapted to be moved radially outwardly by centrifugal force against the spring force to bring the wheels into engagement with the guide track.

2. The apparatus according to claim 1 wherein the plate is removably mounted to the drive shaft.

3. The apparatus according to claim 1 wherein the floor treating discs comprise sanding discs.

4. The apparatus according to claim 1 wherein the floor treating discs comprise polishing discs.

5. The apparatus according to claim 1 wherein the wheels are gears, and the guide track is a ring gear.

6. The apparatus according to claim 1 wherein each disc includes an axle; the plate including radial slots in which respective axles are radially movable; the wheels affixed to respective axles.

7. The apparatus according to claim 1 wherein each disc includes a body and a floor-engaging paper connected thereto.

8. The apparatus according to claim 7 wherein the paper is connected to the body by adhesive.

9. The apparatus according to claim 7 wherein the paper is connected to the body by Velcro.

* * * * *